US011434734B1

(12) United States Patent
Stenmark et al.

(10) Patent No.: US 11,434,734 B1
(45) Date of Patent: Sep. 6, 2022

(54) SUCKER ROD TRANSFER ASSEMBLY

(71) Applicant: Petol Gearench Division of Orbix Corporation, Clifton, TX (US)

(72) Inventors: Ben Stenmark, Clifton, TX (US); Patrick Johnson, Clifton, TX (US); Greg Burbach, Glendive, MT (US)

(73) Assignee: PETOL GEARENCH DIVISION OF ORBIX CORPORATION, Clifton, TX (US)

( * ) Notice: Subject to any disclaimer, the term of this patent is extended or adjusted under 35 U.S.C. 154(b) by 0 days.

(21) Appl. No.: 17/231,138

(22) Filed: Apr. 15, 2021

(51) Int. Cl.

| | |
|---|---|
| ***E21B 19/06*** | (2006.01) |
| ***E21B 43/12*** | (2006.01) |
| ***E21B 19/14*** | (2006.01) |
| ***E21B 17/10*** | (2006.01) |

(52) U.S. Cl.
CPC ..... *E21B 43/127* (2013.01); *E21B 17/1071* (2013.01); *E21B 19/14* (2013.01)

(58) Field of Classification Search
CPC ..... E21B 19/06; E21B 19/14; Y10T 403/61; Y10T 279/17777; Y10T 403/583
See application file for complete search history.

(56) References Cited

U.S. PATENT DOCUMENTS

| | | | | |
|---|---|---|---|---|
| 243,859 | A * | 7/1881 | Cushing | F16B 7/22 294/91 |
| 334,226 | A | 1/1886 | Hellem | |
| 1,024,017 | A | 4/1912 | O'Neil et al. | |
| 1,295,439 | A | 2/1919 | Coveney et al. | |
| 1,527,534 | A | 2/1925 | Black | |
| 1,592,706 | A * | 7/1926 | Prigden | E21B 19/06 294/91 |
| 1,798,296 | A * | 3/1931 | Yerkes | E21B 19/06 294/91 |
| 2,249,162 | A * | 7/1941 | Nielsen | E21B 17/04 403/20 |
| 2,250,642 | A | 7/1941 | Mangham | |
| 2,300,370 | A * | 10/1942 | Lowery | E21B 19/06 294/91 |
| 2,348,611 | A | 5/1944 | Davidson | |
| 4,058,339 | A | 11/1977 | Burchard | |
| 4,483,564 | A * | 11/1984 | McDaniel | B66C 1/00 294/91 |
| 8,746,702 | B1 * | 6/2014 | Benedict | B25D 17/088 279/157 |
| 8,770,898 | B2 * | 7/2014 | Nordlin | B23B 31/1071 408/127 |
| 2022/0018206 | A1 * | 1/2022 | Perschke | E21B 33/068 |

* cited by examiner

*Primary Examiner* — Kipp C Wallace
(74) *Attorney, Agent, or Firm* — Bracewell LLP; Keith R. Derrington

(57) ABSTRACT

A sucker rod transfer assembly for handling a sucker rod prior to the sucker rod being installed for use in a well. The transfer assembly includes an elongated body having a cavity that receives an end of the sucker rod. A slot is formed in an end wall of the body, and an opening extends lengthwise along the body that exposes the cavity. The sucker rod is engaged with the transfer assembly by inserting a tip and shoulder of the sucker rod laterally into the opening while sliding a portion of the sucker rod below the shoulder into the slot. The sucker rod is axially supported in the transfer assembly by interfering contact between the shoulder and edges of the slot. A spring selectively biases safety rings around the sucker rod end to retain the sucker rod end in the cavity.

20 Claims, 5 Drawing Sheets

SUCKER ROD TRANSFER ASSEMBLY

BACKGROUND OF THE INVENTION

1. Field of Invention

The present disclosure relates to an assembly for use with transferring sucker rods, and that includes a means for biasing a safety ring into a retaining configuration.

2. Description of Prior Art

Most wells that produce fluids from subterranean formations typically rely on pressure in the formation to lift liquids upwards within the well to surface. In some of these wells formation pressure is insufficient to lift the liquids in the well to surface; which is sometimes the case initially, or in some instances occurs over time as the formation fluids become depleted. Artificial lift systems for unloading liquids from a well include pumps, such as electrical submersible pumps ("ESP"), which pressurize the liquid downhole and propel it up production tubing that carries the pressurized fluid to surface. Plunger lift pumps are also sometimes employed for lifting liquid from a well, which are usually operated by a reciprocating pump jack that is disposed on surface. A string of sucker rods deployed in the well usually attaches to the pump jack, and that transmits a force from the pump jack to the lift pump.

Sucker rods are elongated members with lengths that generally range from 25 feet to 30 feet, and with diameters from about 0.5 inches to in excess of one inch. Sucker rods are typically formed from carbon steel with varying amounts of manganese, phosphorus, sulfur, silicon, nickel, chromium, and molybdenum. As a result of their size and relatively dense materials, some sucker rods weigh in excess of 100 pounds. Due to their sometimes unwieldy weight, sucker rod transfers are used to handle sucker rods, such as when being unloaded from transport vehicles proximate a well. Sucker rod transfers are typically annular members that are suspended by a cable, and fitted with a slot on its lower end; most sucker rods have a wrench flat proximate an end that inserts into the slot, and which couples the sucker rod transfer with the sucker rod. Some sucker rod transfers include safety rings that are slid into place to retain the sucker rod end inside the transfer. These rings rely on gravity to remain in place and may be moved out of place inadvertently. Which could allow the sucker rod to fall from the transfer and result in property damage or personal injury.

SUMMARY OF THE INVENTION

Described herein is an example of a sucker rod transfer assembly that includes a body, a cavity in the body that selectively receives an end of a sucker rod, a safety ring that is slideable along an outer surface of the body and between, a retracted position that is spaced away from the end of the sucker rod, and a deployed position that is radially adjacent the end of the sucker rod, and a spring that circumscribes the outer surface of the body and that is in biasing contact with the safety ring. In an example, the spring has a spring index of at least around 30 and in an alternative has a spring force of less than 10 pounds force. The sucker rod transfer assembly further optionally includes a spring retaining ring mounted to an end of the body; which in an embodiment includes a frusto-conical crown on one end, a base on an opposite end, and a reduced diameter portion between the crown and base that defines a recess in which the spring disposed. In an example, a slot is formed radially through the base. An optional opening is included in the body that extends along a length of the body and that provides access to the cavity. In an embodiment an axial end of the spring is in contact with the safety ring along the full circumference of the safety ring.

Also disclosed is a method of transferring a sucker rod, and that includes obtaining a sucker rod transfer assembly that is made up of, an elongated body, a cavity in the body, an opening along a length of the body in communication with the cavity, a safety ring on an outer surface of the body, and a spring in biasing contact with the safety ring. The method of this example also includes manually sliding the safety ring along the length of the body to compress the spring, inserting an end of a sucker rod into the cavity through the opening, and releasing the safety ring so that the safety ring is moved into a deployed position that circumscribes a portion of the sucker rod and is in interfering contact with movement of the end of the sucker rod from within the cavity through the opening. The spring optionally has a spring index of at least 30 and in an alternative has a spring constant of around 10 lbf/in. In one example, the method further includes lifting the transfer assembly and sucker rod from a transport vehicle to a rack disposed proximate a well; and also optionally includes installing the sucker rod into a string of sucker rods mounted in the well, reciprocating the string of sucker rods to lift fluid from within the well. In an alternative, the spring is in sliding contact with the outer surface of the body.

Another example of a sucker rod transfer assembly is disclosed and that includes an elongated body having, a curved outer surface, an inner cavity, a lengthwise axis, sidewalls that span a length of the body and that extend around a portion of the axis circumference to define spaced apart radial surfaces, an opening between the spaced apart radial surfaces that defines an access to the cavity, a base formed on an axial end of the sidewalls and extends radially inward from the sidewalls, a slot in the base, a shoulder formed on a portion of the base that extends radially past an outer circumference of the sidewalls, and a recess formed longitudinally along an outer surface of the sidewalls. Also included with the transfer assembly is a safety ring that circumscribes the axis and is slideable along the outer surface of the sidewalls and a spring in close contact with the outer surface of the sidewalls and that biases the safety ring towards the base. In an alternative, a crown is provided on an axial end of the sidewalls opposite from the base and a spring retaining ring circumscribing the crown, wherein an axial end of the spring distal from the safety ring abuts a lateral surface of the spring retaining ring. In an embodiment an outer diameter of the crown exceeds an inner diameter of the spring. In this example, the cavity selectively receives an end of a sucker rod, wherein the spring exerts a resistive force of up to about 10 pounds-force against the safety ring in response to a manually applied force that slides the safety ring away from the base and to a position that is out of interfering contact with the end of the sucker rod, and wherein when the manually applied force is released the spring biases the safety ring against the base and in interfering contact with the movement of the end of the sucker rod from within the cavity.

BRIEF DESCRIPTION OF DRAWINGS

Some of the features and benefits of the present invention having been stated, others will become apparent as the description proceeds when taken in conjunction with the accompanying drawings, in which.

DETAILED DESCRIPTION OF INVENTION

Figure 1:
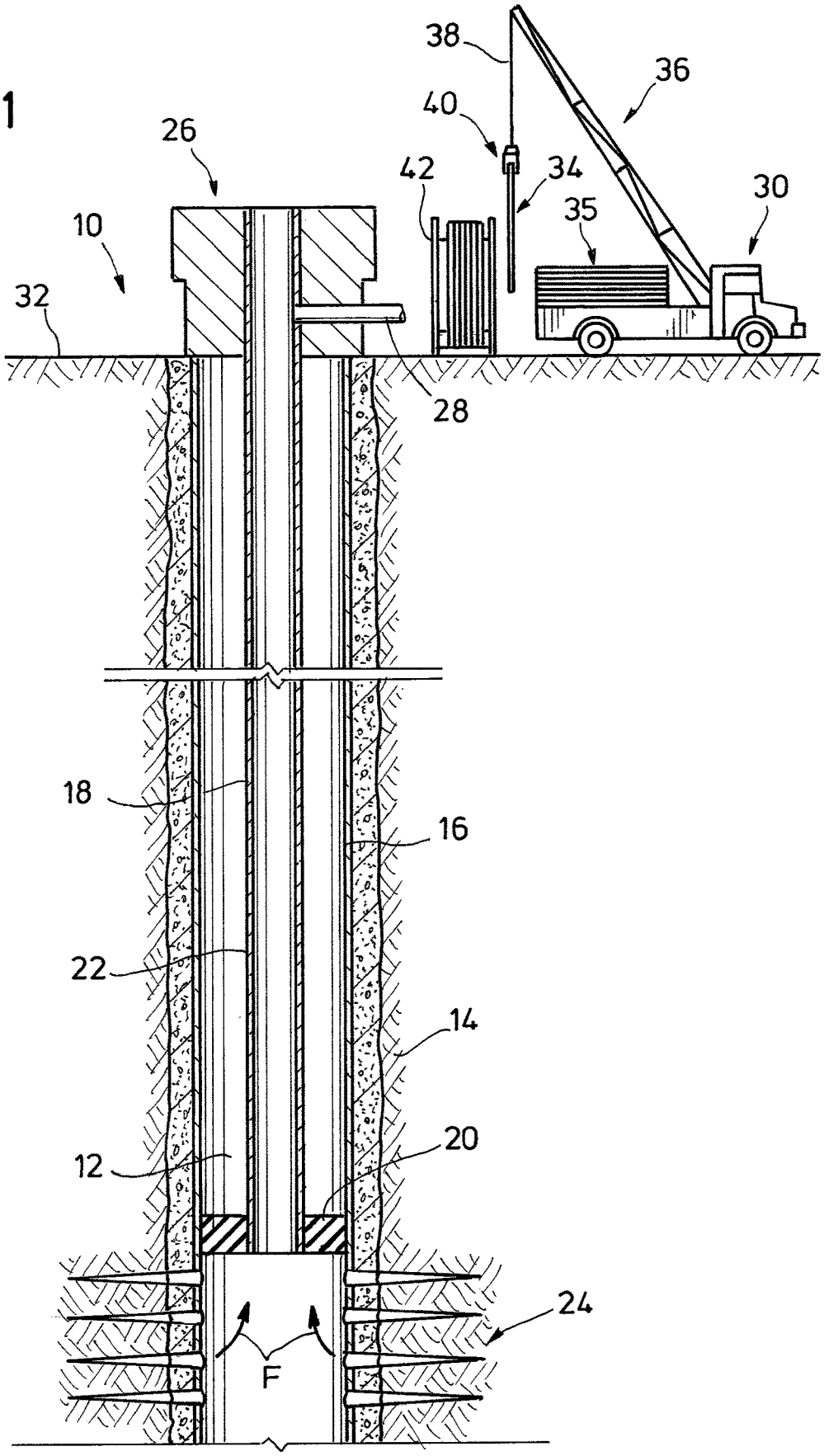
FIG. 1 is a side partial sectional view of an example of sucker rods being delivered to a wellsite.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side partial sectional view in FIG. 1 is an example of a well system 10 that includes a wellbore 12 formed into a subterranean formation 14. Wellbore 12 in this example is lined with casing 16 shown with production tubing 18 installed within the casing 16. A packer 20 is installed in the wellbore 12 proximate a lower end of the production tubing 18 and spans across an annulus 22 formed between the production tubing 18 and casing 16. Perforations 24 project radially outward from the wellbore 12 through the casing 16 and into the surrounding formation 14. Fluid F is depicted flowing into the wellbore 12 from the formation 14 through perforations 24, packer 20 blocks fluid F from entering the annulus 22 and diverts fluid F into production tubing 18. Fluid F flowing upward inside production 18 is directed to a wellhead assembly 26 shown formed over wellbore 12. In this example, wellhead assembly 26 provides pressure control for wellbore 12 and provides a pathway within for the fluid F to enter a production flow line 28 shown with an end attached to wellhead assembly 26, and extending from the well head assembly 26 and provides a way for transporting fluid F away from wellbore 12.

In this example a service truck 30 is depicted on surface 32, and sucker rods 34 are being unloaded from the service truck 30. The sucker rods 34 are shown arranged within a stack 35 of sucker rods 34 and on a bed of the service truck 30. Included with service truck 30 is a crane 36 equipped with a cable 38 that in combination with an example of a transfer device 40, unload the sucker rods 34 from service truck 30 and onto a rack 42 installed adjacent the well system 10. As described in more detail below, in a non-limiting example transfer device 40 manually engages each of sucker rods 34 by operations personnel (not shown); and the engaged sucker rod 34 is hoisted from the bed of the service truck 30 by to retracting cable 38 with a drum or reel (not shown) to lift both the transfer device 40 and engaged sucker rod 34.

Figure 2:
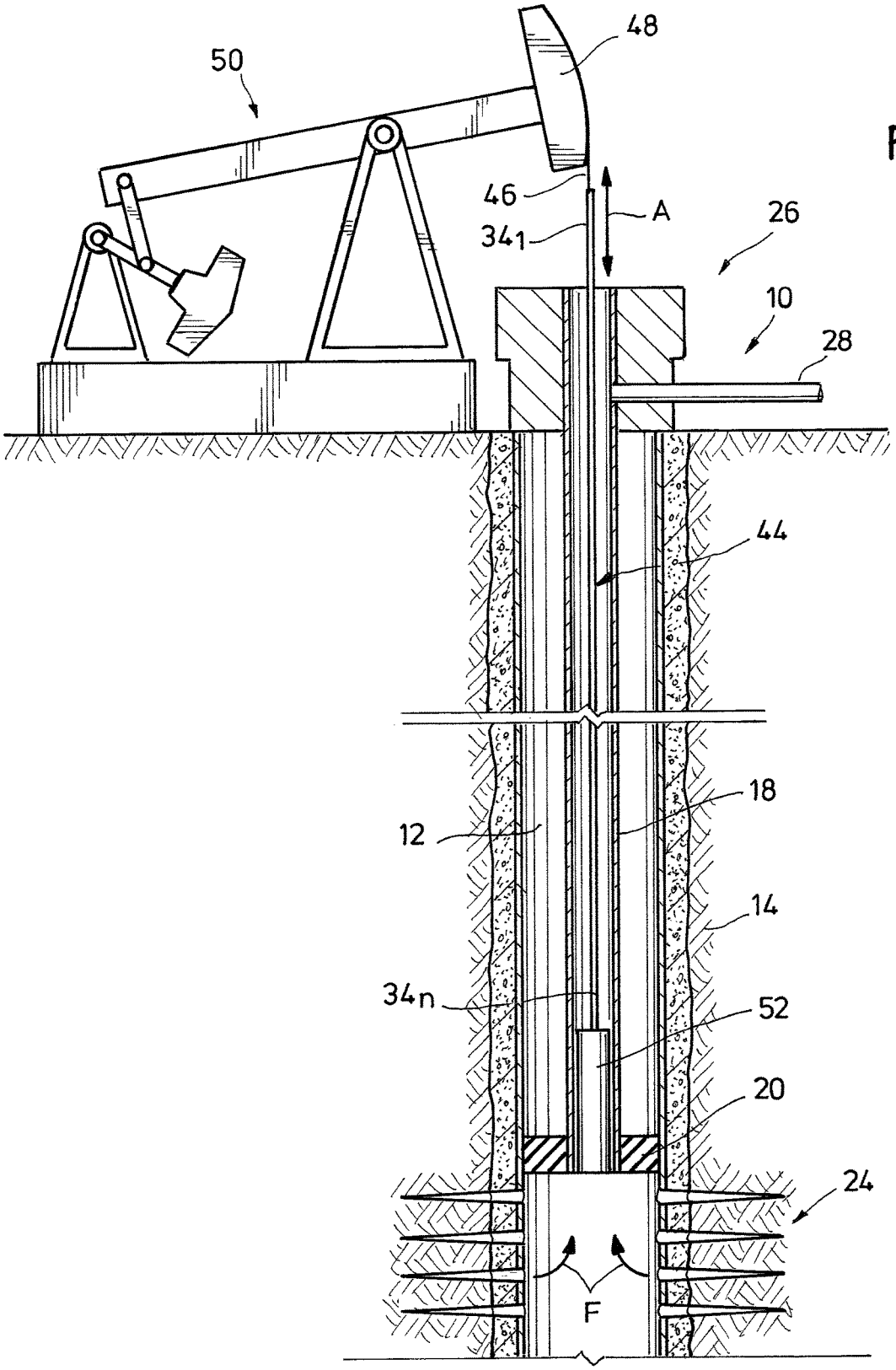
FIG. 2 is a side partial sectional view of an example of an artificial lift system using the sucker rods of FIG. 1

Referring now to FIG. 2, shown in a side partial sectional view is an example of the sucker rods $\mathbf{34}_{1\text{-}n}$ coupled together in series to form a sucker rod string 44 that is installed within the production tubing 18. And end of the string 44 that extends outside of wellbore 12 and above wellhead assembly 26 attaches to a cable 46 shown attached to a horse head 48. Cable 46 and horse head 48 are part of a pump jack assembly 50, a motor (not shown) is included with pump jack assembly 50 that through the articulated linkage causes cable 46 and horse head 48 to reciprocate as illustrated by the double headed arrow A. The reciprocating motion of the cable 46 and horse head 48, via their coupling to the string 44, deliver a reciprocating motive force to a pump 52 shown installed in the wellbore 12 and within a lower end of production tubing 18. In the example of FIG. 2, fluid F exiting perforations 24 is artificially lifted by pump 52; and the pump 52 is driven by reciprocating the string 44 with the pump jack assembly 50. Fluid F makes its way to the wellhead assembly 26 and through the production line 28 is transported off site for processing.

Figure 3A:
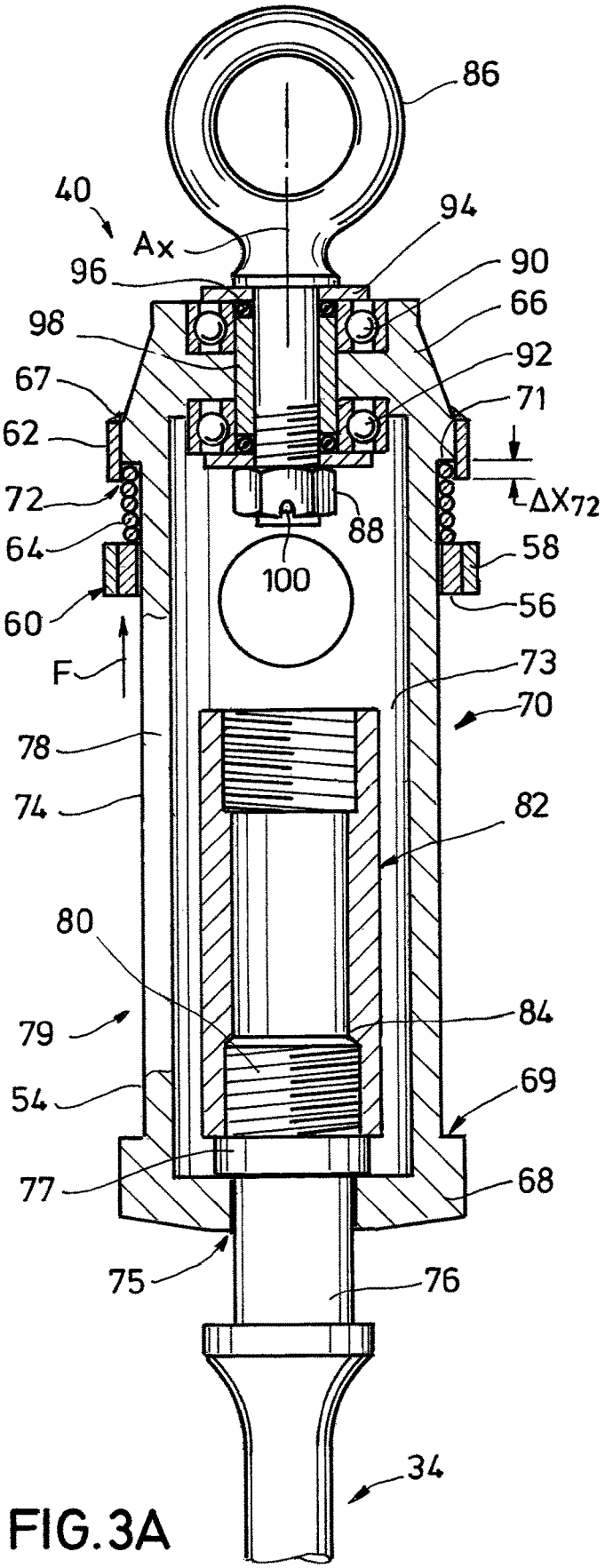
FIG. 3A is a side partial sectional view of an example of a sucker rod transfer assembly receiving an end of a sucker rod, and with safety rings in a retracted configuration

Shown in a side partial sectional view in FIG. 3A is an example of transfer device 40 coupled to a sucker rod 34; and as illustrated in FIG. 1, for transferring sucker rod 34 from the service truck 30 onto rack 42. In the example shown, transfer device 40 includes a generally elongated transfer body 54, an inner safety ring 56 circumscribing an outer surface of body 54, and an outer safety ring 58 circumscribing inner safety ring 56. As shown, a safety ring fastener 60 couples rings 56, 58 together. In alternatives a single ring (not shown) is in place of rings 56, 58. In the example shown fastener 60 is a threaded member, and alternatives include press fit, solder, and a tack weld. This example includes a spring retaining ring 62 depicted circumscribing body 54 at a location spaced axially away from the rings 56, 58, and a spring 64 axially compressed between rings 56, 58 and spring retaining ring 62. Spring 64 is shown in an axially compressed configuration with its individual coils $\mathbf{65}_{1\text{-}n}$ proximate one another. The portion of body 54 where spring retainer ring 62 is shown is referred to herein as a crown 66, which is shown having a generally frustoconical configuration with an outer surface that decreases radially away from ring 62 and having an upper surface which is generally planar. In the example shown, an optional tack weld 67 secures spring retainer ring 62 to the crown 66. Alternatively, ring 62 is coupled to crown 66 by one or more of fasteners, threads, solder, or a press fit. A base 68 is provided on an end of body 54 distal from spring retaining ring 62, base 68 is defined where an outer diameter of body 54 is locally increased. An upward facing shoulder 69 is formed on a radial surface of base 68 shown adjacent where base 68 adjoins body 54. A recess 70 is defined in the annular space that is bounded on its axial ends by shoulder 69 and a downward facing shoulder 71 formed by a radial wall of crown 66 shown facing towards shoulder 69, an inner radius of recess 70 is along an outer surface of body 54. In an alternative, spring retaining ring 62 extends axially past shoulder 71 and circumscribes a portion of recess 70 to define an annular pocket 72 shown having an axial length $\Delta X_{72}$.

Still referring to FIG. 3A, a cavity 73 is formed within body 54 and extends radially outward from an axis Ax of body 54 to define sidewalls 74 that are shown extending along a length of body 54. Base 68, in addition to projecting radially outward from an outer surface of sidewalls 74, projects radially inward a distance past an inner radius of sidewalls 74. A channel 75 is shown formed within the base 68 and along its midsection. In this example channel 75 forms an open space for receiving a wrench flat 76 shown inserted into the channel 75. Wrench flat 76 is formed on sucker rod 34 adjacent a shoulder 77 shown with an outer diameter exceeding the width of channel 75; sliding wrench flat 76 into channel 75 allows for sucker rod 34 to be supported within body 54 as the shoulder 77 is supported on along opposing edges of the channel 75. In the examples shown, sidewalls 74 circumscribe a portion of axis Ax, and the opposing terminal ends of sidewalls 74 define radial surfaces 78 that extend along the length of cavity 73 and are angularly spaced apart from one another. An opening 79 is defined in the angular space between the radial surfaces 78 that provides an access for placing a sucker rod end 80 into cavity 73 while wrench flat 76 is inserted into channel 75. An annular coupling 82 is illustrated threadingly attached to the sucker rod end 80 and provides a means for attaching adjacent sucker rods 34 to one another. A bore 84 extends axially through coupling 82 and in the example illustrated threads are provided within bore 84 on opposing ends to allow insertion and threading attachment of adjacently disposed sucker rods 34. An eyebolt 86 is shown coupled to an end of body 54 distal from channel 75 for applying a force to lift transfer device 40 and attached sucker rod 34, such as by the line 38 of service truck 30 (FIG. 1). In the embodiment of FIG. 3A, eyebolt 86 includes a threaded portion shown projecting through an opening formed axially through the crown 66 and which is engaged by a nut 88 to compressively attach eyebolt 86 to body 54. Bearings 90, 92 are shown circumscribing the longer portions of eyebolt 86 and provide a means for relative rotation of eyebolt 86 to body 54.

Figure 3B:
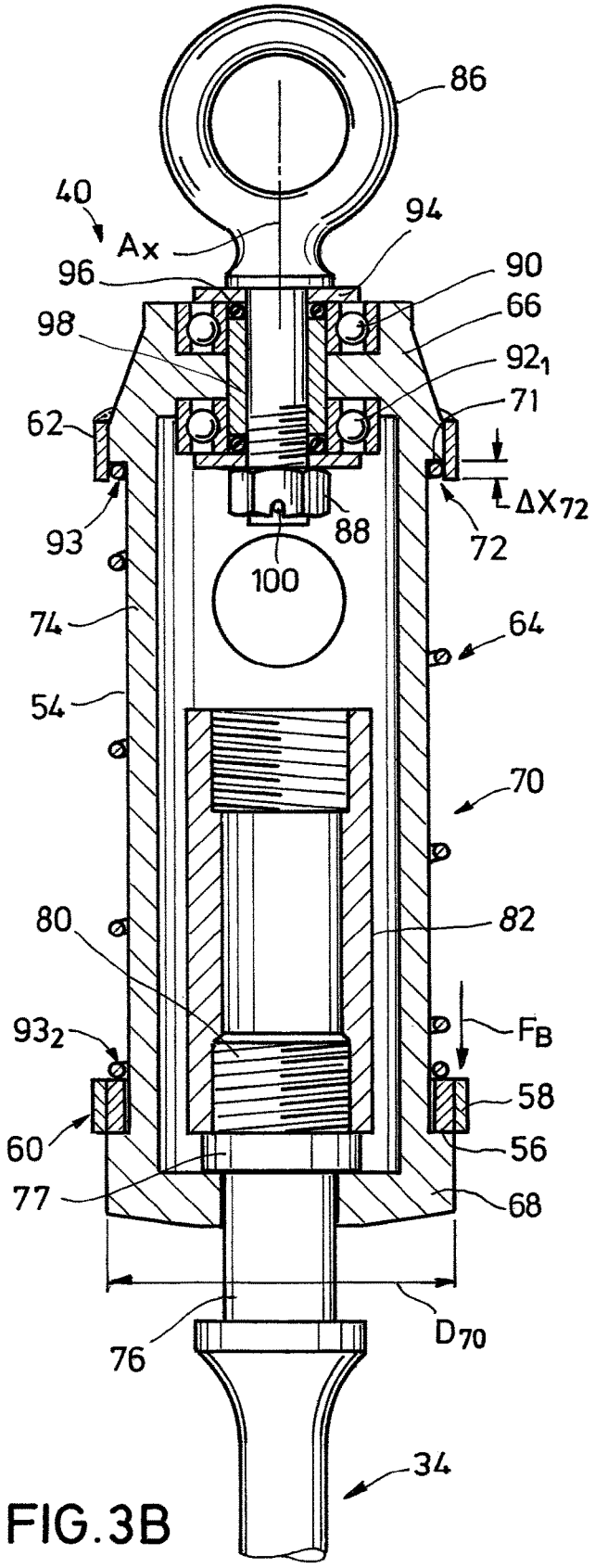
FIG. 3B is a side partial sectional view of an example of the sucker rod transfer assembly of FIG. 3A and with the safety rings in a deployed configuration.
Figure 5:
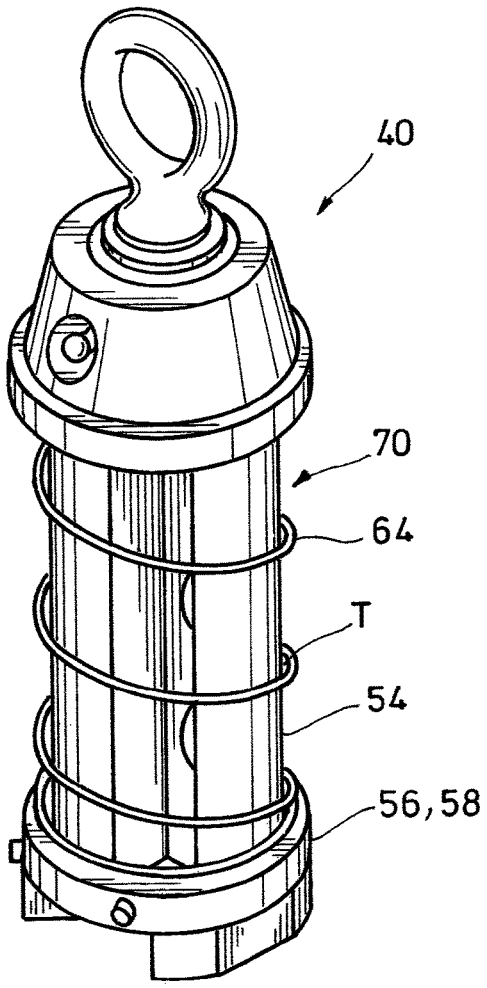
FIG. 5 is a perspective view of an example of the sucker rod transfer assembly of FIG. 3B, While subject matter is described in connection with embodiments disclosed herein, it will be understood that the scope of the present disclosure is not limited to any particular embodiment. On the contrary, it is intended to cover all alternatives, modifications, and equivalents thereof.
Figure 4:
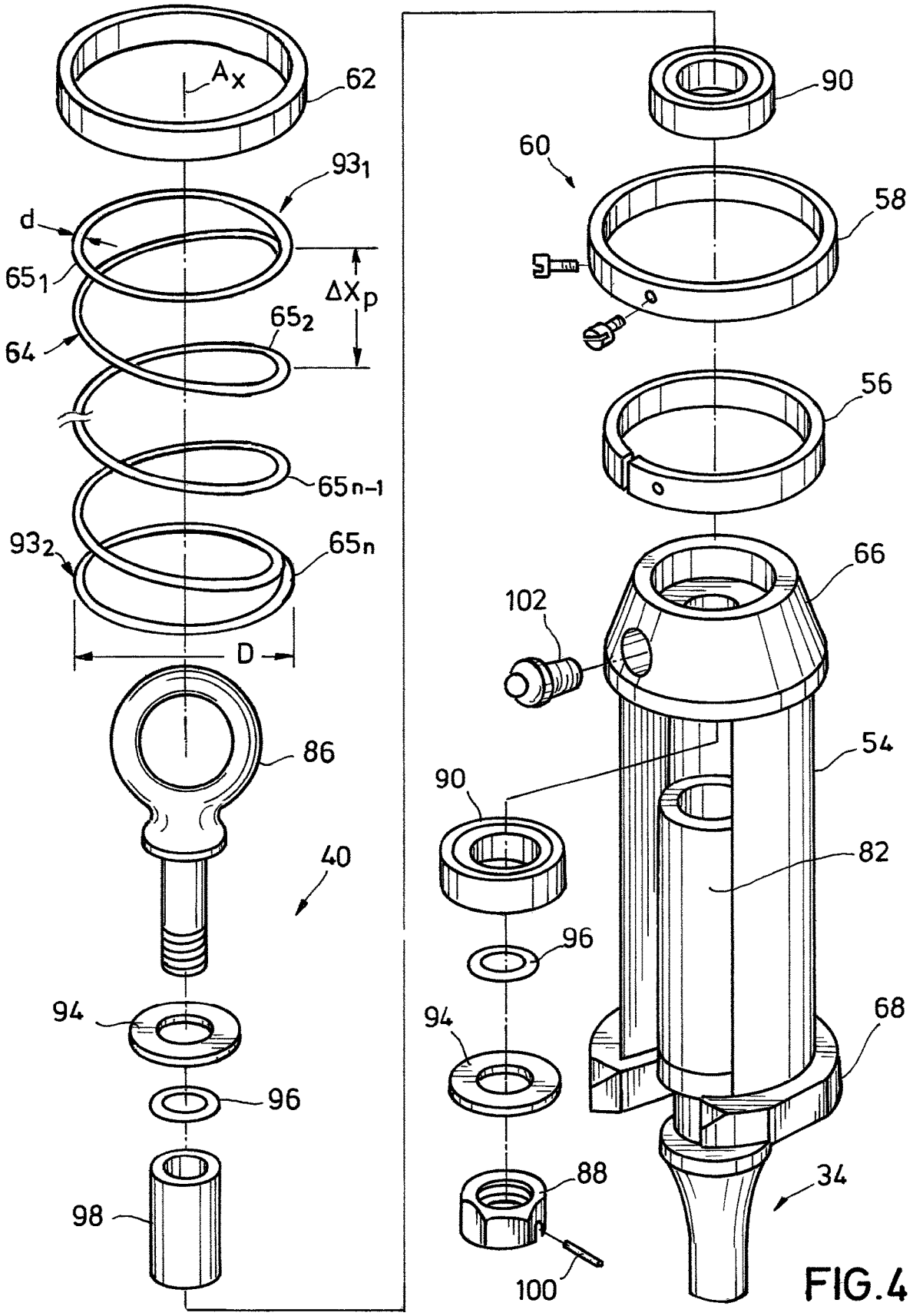
FIG. 4 is a perspective exploded view of the sucker rod transfer assembly of FIGS. 3A and 3B.

Referring now to FIG. 4, an example of the transfer device 40 of FIG. 3A is shown in an exploded view. As illustrated in the exploded view, spring 64 is shown in a relaxed or uncompressed configuration and made up of a wire W fashioned into a helical configuration with coils $\mathbf{65}_{1\text{-}n}$ axially adjacent one another. Examples of material making up wire W include high carbon steel, music wire, and in specific embodiments wire W material constituents include iron, carbon, manganese, silicone, sulfur, and phosphorus; and optionally have respective percentages by weight of 98-99, 0.7-1.0, 0.2-0.6, 0.1-0.3, 0.0-0.030, and 0.0-0.025. Wire W has a diameter d and the spring 64 has an inner diameter D. In an example diameter D exceeds the diameter of recess $D_{70}$ (FIG. 3B) by an amount to not restrict the spring 64 when being reconfigured between its compressed and relaxed configurations; example tolerances T (FIG. 5) between the inner diameter of the spring 64 and recess 70 are around 0.035 inches. For the purposes of discussion herein, each of the coils $\mathbf{65}_{1\text{-}n}$ represent a portion of the wire W that circumscribe the axis Ax by about 360°. Coils $\mathbf{65}_{1,\ n}$ are shown forming opposing terminal ends $\mathbf{93}_{1,2}$ of spring 64, and in this example coils $\mathbf{65}_{1,\ n}$ are largely in the same plane, whereas coils $\mathbf{652}_{2\text{-}(n+1)}$ are shown having a length $\Delta X_P$ along axis Ax. In this example a washer 94 is between bolt nut 88 and bearing 92, and an o-ring 96 is included between washer 94 and bearing 92. An optionally bushing 98 is shown for covering a threaded portion of eyebolt 86, and which provides a collar like protection between the threaded portion of eyebolt 86 and inner diameter of the opening that extends through the crown 66. An optional pin 100 is provided for maintaining the threaded connection of nut 88 onto the threaded portion of eyebolt 86. Also, an optional grease fitting 102 provides a means for introducing lubricant into the bearings 90, 92.

Referring back to the example of FIG. 3A, spring 64 is in a compressed configuration and in which a force F is schematically depicted being applied in a direction away from shoulder 69 towards ring 62 and used for compressing spring 64 into the compressed configuration. In this example force F exceeds an elastic spring force or elastic potential energy of the spring 64, and potential energy is stored in the spring 64 when in the compressed configuration. Referring now to FIG. 3B, shown is a side partial sectional view of an example of the transfer assembly 40 without the force F being applied to the rings 56, 58 (or spring 64) so that elastic spring force or elastic potential energy in the spring 64 causes the spring 64 to return to an uncompressed relaxed state, which for the purposes of discussion herein is alternatively referred to as an expanded configuration. Reconfiguring the spring 64 from its compressed configuration to the expanded configuration shown in FIG. 3B, biases the inner and outer safety rings 56, 58 axially away from the crown 66 (from their open position) and into abutting contact with the shoulder 69. In embodiments, after the force F is released the elasticity of material making up the wire W causes spring 64 to automatically expand back to its uncompressed configuration and as the spring 64 axially expands, contact between terminal end $\mathbf{93}_2$ and rings 56, 68 urges the rings 56, 58 substantially instantaneously into the abutting contact with the shoulder 69. In examples, resultant forces are generated by impact of the rings 56, 58 against the shoulder 69 that transfer into the spring 64, and are of sufficient magnitude to cause axial and radial movement of terminal end $\mathbf{93}_1$, which in embodiments dislodges terminal end $\mathbf{93}_1$ from its abutting contact with shoulder 71 and allowing terminal end $\mathbf{93}_1$ to move axially past shoulder 71 in a direction away from shoulder 69. In the example shown, the combination of shoulder 71 and spring retaining ring 62 forms a semi-enclosed space, and by positioning terminal end $\mathbf{93}_1$ within pocket 72 restricts and arrests axial and radial movement of the terminal end $\mathbf{93}_1$. Restricting movement of terminal end $\mathbf{93}_1$ by its insertion into pocket 72 prevents terminal end $\mathbf{93}_1$ from moving past shoulder 71 and retains spring 64 within recess 70; even when the above discussed impact forces would otherwise extricate spring 64 from recess 70. In examples, axial length $\Delta X_{72}$ ranges from around 0.5(d) to around 4(d), from around 1(d) to around 3(d), from around 1.5(d) to around 2(d), any combination of the upper and lower ranges listed herein, and all values within the ranges, When the inner and outer safety rings 56, 58 are abutting or proximate to the shoulder 69, the rings 56, 58 (and/or transfer device 40) are in what is referred to as a retaining or closed configuration. When the rings 56, 58 are positioned adjacent shoulder 69, the rings 56, 58 interfere with radial movement of the end of sucker rod 80 from within cavity 73, and prevent disengagement of sucker rod 34 from the transfer device 40. The spring 64 provides a significant advantage over currently known methods of positioning a safety ring into a retaining or safety configuration to prevent the sucker rod from being dislodged from the transfer device. For example, known means rely on gravity or manual positioning of the ring into that configuration. An additional advantage is that without a force F being applied to the spring 64 that exceeds a spring force of the spring 64, the spring 64 automatically and constantly exerts a biasing force $F_B$ against rings 56, 58 that not only repositions the rings 56, 58 from their open position to the retaining/closed configuration, but also maintains rings 56, 58 in the closed configuration to retain the sucker rod and 80 within body 54 thereby maintaining continued coupling between the transfer device 40 and the associated sucker rod 34. Spring 64 therefore, provides a continuous and automatic securement and safety means to prevent unintended disengagement of a sucker rod from transfer device 40 and preventing the damage as well as personal injury.

In a non-limiting example, the design of the spring 64 is unconventional in that it has a spring index in excess of 30 due to a ratio between its mean diameter D (FIG. 0.4) and wire diameter d. Such a large spring index is considered by those skilled to not capable of being manufactured, but also unwieldy and prone to tangling and converting into a configuration that incapable of generating a sufficient or reliable biasing force. In embodiments, the spring 64 has a spring force of up to about 10 pounds-force, which allows operations personnel to manually and individually move the rings 56, 58 from the position shown in FIG. 3B and into the compressed configuration of FIG. 3A by applying force F. A conventional spring made with typical manufacturing parameters would result in a spring force such that compressing the convention spring into a compressed configuration, would require applying a force of a magnitude making it difficult for operations personnel to manually compress the spring 64 as shown in FIG. 3A.

Example

In a non-limiting example, provided in Table 1 are characteristics of springs A and B, which are for use with the present disclosure; and characteristics of springs C and D, which are made in accordance with standard or known manufacturing practices. Each of springs A-D in this example are formed from a spring material with a rigidity of $1.15\times10^7$ pounds/inch$^2$.

TABLE 1

| | SPRING A | SPRING B | SPRING C | SPRING D |
|---|---|---|---|---|
| Mean diameter (in) | 2.92 | 3.23 | 2.92 | 3.23 |
| Wire diameter (in) | 0.080 | 0.1 | 0.139 | 0.154 |
| # of coils | 3.25 | 3.25 | 3.25 | 3.25 |
| Spring Index | 35.38 | 31.30 | 20.0 | 20.0 |
| Free length (in) | 6.5 | 6.5 | 6.5 | 6.5 |
| Solid length (in) | 0.34 | 0.43 | 0.59 | 0.65 |
| Spring rate (lbs/in) | 0.80 | 1.44 | 7.66 | 8.50 |
| Spring Force (lbf) | 5.0 | 8.8 | 45.0 | 55.0 |

As shown in Table 1 Springs C and D each have a spring index of 20, which is a value at an upper range those skilled would consider for satisfactory operation or that could be manufactured. Forming springs in accordance with these standard practices though results in spring forces of 45 pounds-force and 50 pounds-force for springs C and D; which would make these springs impractical for manual operation. In contrast, springs A and B have spring forces of 5.0 and 8.8 respectively; which are well within ranges of force that an operations personnel is capable of handling alone (i.e. to apply a force F to spring 64 or rings 56, 58 to transform the spring 64 from its expanded co and without assistance from others and without the need for a device or apparatus to gain a mechanical advantage. While springs A and B have respective spring indexes of 35.38 and 31.30, they are capable of manufacture; and provide an adequate biasing force FB for automatically putting safety rings 56, 58 into the retaining or closed configuration, and maintaining the rings 56, 58 in this configuration.

In a non-limiting example of operation and referring back to FIG. 1, operations personnel maneuver the transfer device 40 onto a sucker rod end 80 of a sucker rod 34 mounted on a service truck 30 and by reeling in line 38 wound through crane 36, the transfer device 40 engages the sucker rod 34 and which is movable onto rack 42 as discussed above. The force F for moving rings 56, 58 from their interfering position of FIG. 3B is applied manually and with a nominal force supplied by an operations personnel, and without the use of any machine or mechanism the rings 56, 58 are easily positioned out of the interfering position and so that the end of the sucker rod 80 is insertable within the cavity 70 of body 54. By operations personnel releasing rings 56, 58 and removing force F being applied to put the spring into the compressed configuration of FIG. 3A, the biasing force $F_B$ automatically biases the rings 56, 58 towards shoulder 69 and into the interfering position to retain the sucker rod end 80 within the body 54 of transfer device 40. With the rings 56, 58 in the interfering position, the transfer device 40 is engaged with the sucker rod 34. So that the 90 degree repositioning of the sucker rod 34 and coupled transfer device 40 from the generally horizontal configuration when on the service truck 30 into the vertical configuration on the rack 42 and while being suspended from line 38; the safety rings 56, 58 are held in place automatically and continuously by the spring 64. Whereas conventional rings could be moved by gravity out of an interfering position and allow the sucker rod 34 to fall from a transfer device. By manipulating of the crane 36 and or line 38 the transfer device 40 with attached sucker rod 34 is positioned into place adjacent rack 42 for placing of the sucker rods 34 and later deployment into the wellbore 12. Disengaging the sucker rod 34 from the transfer device involves a manually applied force F (FIG. 3A) such as by a single operations personnel, then simply disengaging the body 54 from the sucker rod end by pulling the body 54 laterally or radially away from the sucker rod end 80 while at the same time maintaining application of the nominal force F to the rings 56, 58 and to keep the spring 64 in its compressed configuration. And the process is repeated with each successive sucker rod 34.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A sucker rod transfer assembly comprising:

a body;

a cavity in the body that selectively receives an end of a sucker rod;

a safety ring that is slideable along an outer surface of the body and between, a retracted position that is spaced away from the end of the sucker rod, and a deployed position that is radially adjacent the end of the sucker rod; and a spring that circumscribes the outer surface of the body and that is in biasing contact with the safety ring wherein the body comprises a crown on one end which extends radially outwardly from the body, a base on an opposite end which extends radially outwardly from the body, and a reduced diameter portion between the crown and base that defines a recess in which the spring disposed.

2. The sucker rod transfer assembly of claim 1, wherein the spring has a spring index of at least around 30.

3. The sucker rod transfer assembly of claim 1, wherein the spring force is less than 10 pounds force.

4. The sucker rod transfer assembly of claim 1, further comprising a spring retaining ring mounted to an end of the body that defines a pocket, wherein the pocket circumscribes a terminal end of the spring and forms a barrier to radial movement of the spring.

5. The sucker rod transfer assembly of claim 1, wherein the crown is frusto-conical.

6. The sucker rod transfer assembly of claim 5, wherein a slot is formed radially through the base.

7. The sucker rod transfer assembly of claim 1, wherein the body includes an opening that extends along a length of the body and that provides access to the cavity.

8. The sucker rod transfer assembly of claim 1, wherein an axial end of the spring is in contact with the safety ring along the full circumference of the safety ring.

9. A method of transferring a sucker rod comprising:

obtaining a sucker rod transfer assembly that comprises, an elongated body, a cavity in the body, an opening along a length of the body in communication with the cavity, a safety ring on an outer surface of the body, and a spring circumscribing the body and in biasing contact with the safety ring;

manually sliding the safety ring along the length of the body to compress the spring;

inserting an end of a sucker rod into the cavity through the opening; and releasing the safety ring so that the safety ring is moved into a deployed position that circumscribes a portion of the sucker rod and is in interfering contact with movement of the end of the sucker rod from within the cavity through the opening.

10. The method of claim 9, wherein the spring has a spring index of at least 30.

11. The method of claim 9, wherein the spring has a spring force up to around 10 pounds-force.

12. The method of claim 9, further comprising lifting the transfer assembly and sucker rod from a transport vehicle to a rack disposed proximate a well.

13. The method of claim 12, further comprising installing the sucker rod into a string of sucker rods mounted in the well, reciprocating the string of sucker rods to lift fluid from within the well.

14. The method of claim 9, wherein the spring is in sliding contact with the outer surface of the body.

15. The method of claim 9, further comprising arresting radial movement of the spring on an end opposite from where the spring is in contact with the safety ring.

16. A sucker rod transfer assembly comprising:

an elongated body having, a curved outer surface, an inner cavity, a lengthwise axis, sidewalls that span a length of the body and that extend around a portion of a circumference of the axis to define spaced apart radial surfaces, an opening between the spaced apart radial surfaces that defines an access to the cavity, a base formed on an axial end of the sidewalls and extending radially inward from the sidewalls, a slot in the base, a shoulder formed on a portion of the base that extends radially past an outer circumference of the sidewalls, a recess formed longitudinally along an outer surface of the sidewalls;

a safety ring that circumscribes the axis and is slideable along the outer surface of the sidewalls; and a spring circumscribing the body in close contact with the outer surface of the sidewalls and that biases the safety ring towards the base.

17. The assembly of claim 16, further comprising a crown on an axial end of the sidewalls opposite from the base and a spring retaining ring circumscribing the crown, wherein an axial end of the spring distal from the safety ring abuts a lateral surface of the spring retaining ring.

18. The assembly of claim 16, wherein an outer diameter of the crown exceeds an inner diameter of the spring.

19. The assembly of claim 16, wherein the cavity selectively receives an end of a sucker rod, wherein the spring exerts a resistive force of up to about 10 pounds-force against the safety ring in response to a manually applied force that slides the safety ring away from the base and to a position that is out of interfering contact with the end of the sucker rod, and wherein when the manually applied force is released the spring biases the safety ring against the base and in interfering contact with the movement of the end of the sucker rod from within the cavity.

20. The assembly of claim 16, further comprising a spring retaining ring that circumscribes a portion of the recess and forms a barrier to radial movement of and end of the spring from the recess.

* * * * *